US008378965B2

(12) United States Patent
Gregorio et al.

(10) Patent No.: US 8,378,965 B2
(45) Date of Patent: Feb. 19, 2013

(54) VIBRATION ACTUATOR WITH A UNIDIRECTIONAL DRIVE

(75) Inventors: Pedro Gregorio, Verdun (CA); Danny A. Grant, Montreal (CA); Juan Manuel Cruz-Hernandez, Montreal (CA)

(73) Assignee: Immersion Corporation, San Jose, CA (US)

( * ) Notice: Subject to any disclaimer, the term of this patent is extended or adjusted under 35 U.S.C. 154(b) by 1239 days.

(21) Appl. No.: 11/733,453

(22) Filed: Apr. 10, 2007

(65) Prior Publication Data

US 2008/0252594 A1 Oct. 16, 2008

(51) Int. Cl.
*G09G 5/00* (2006.01)

(52) U.S. Cl. ..... 345/156; 715/702

(58) Field of Classification Search ..... 345/156; 715/702; 318/128, 166
See application file for complete search history.

(56) References Cited

U.S. PATENT DOCUMENTS

| | | | | |
|---|---|---|---|---|
| 4,408,857 | A * | 10/1983 | Frank | 396/449 |
| 5,959,613 | A * | 9/1999 | Rosenberg et al. | 345/161 |
| 6,538,402 | B2 * | 3/2003 | Gokturk et al. | 318/128 |
| 6,664,714 | B2 * | 12/2003 | Magnussen et al. | 310/354 |
| 6,822,635 | B2 * | 11/2004 | Shahoian et al. | 345/156 |
| 7,084,854 | B1 | 8/2006 | Moore et al. | |
| 7,639,232 | B2 * | 12/2009 | Grant et al. | 345/156 |
| 2005/0156892 | A1 * | 7/2005 | Grant | 345/167 |
| 2005/0219206 | A1 | 10/2005 | Schena et al. | |
| 2007/0202841 | A1 * | 8/2007 | Cruz-Hernandez et al. | 455/403 |

FOREIGN PATENT DOCUMENTS

| | | | |
|---|---|---|---|
| WO | 2004077658 | A1 | 9/2004 |
| WO | WO 2004077658 | A1 * | 9/2004 |

OTHER PUBLICATIONS

Official Communication issued in the corresponding Chinese Patent Application No. 200880010775.X, mailed Oct. 26, 2010.

* cited by examiner

*Primary Examiner* — Kevin M Nguyen
*Assistant Examiner* — Kenneth B Lee, Jr.
(74) *Attorney, Agent, or Firm* — Squire Sanders (US) LLP

(57) ABSTRACT

A haptic feedback generation system includes a linear resonant actuator and a drive circuit. The drive circuit is adapted to output a unidirectional signal that is applied to the linear resonant actuator. In response, the linear resonant actuator generates haptic vibrations.

19 Claims, 5 Drawing Sheets

VIBRATION ACTUATOR WITH A UNIDIRECTIONAL DRIVE

FIELD OF THE INVENTION

One embodiment of the present invention is directed to an actuator. More particularly, one embodiment of the present invention is directed to an actuator used to create vibrations on a haptic enabled device.

BACKGROUND INFORMATION

Electronic device manufacturers strive to produce a rich interface for users. Conventional devices use visual and auditory cues to provide feedback to a user. In some interface devices, kinesthetic feedback (such as active and resistive force feedback) and/or tactile feedback (such as vibration, texture, and heat) is also provided to the user, more generally known collectively as "haptic feedback." Haptic feedback can provide cues that enhance and simplify the user interface. Specifically, vibration effects, or vibrotactile haptic effects, may be useful in providing cues to users of electronic devices to alert the user to specific events, or provide realistic feedback to create greater sensory immersion within a simulated or virtual environment.

Haptic feedback has also been increasingly incorporated in portable electronic devices, such as cellular telephones, personal digital assistants (PDAs), portable gaming devices, and a variety of other portable electronic devices. For example, some portable gaming applications are capable of vibrating in a manner similar to control devices (e.g., joysticks, etc.) used with larger-scale gaming systems that are configured to provide haptic feedback. Additionally, devices such as cellular telephones and PDAs are capable of providing various alerts to users by way of vibrations. For example, a cellular telephone can alert a user to an incoming telephone call by vibrating. Similarly, a PDA can alert a user to a scheduled calendar item or provide a user with a reminder for a "to do" list item or calendar appointment.

In many devices, an actuator is used to create the vibrations that comprise some haptic effects. One type of actuator that is frequently used in portable electronic devices is a Linear Resonant Actuator ("LRA"). Typically, an LRA requires a bidirectional signal (i.e., an alternating positive voltage and negative voltage signal) in order to create the desired vibrations. However, most portable electronic devices generate direct current only, so that a special drive circuit is required to generate the bidirectional signal. The typical circuit includes a H-bridge, which is a circuit that includes four switches. However, for portable devices, cost is an important driving factor, and the cost of four switches may be proportionally high relative to the rest of the portable device.

Based on the foregoing, there is a need for a less expensive actuator and drive circuit for generating haptic effects.

SUMMARY OF THE INVENTION

One embodiment of the present invention is a haptic feedback generation system that includes a linear resonant actuator and a drive circuit. The drive circuit is adapted to output a unidirectional signal that is applied to the linear resonant actuator. In response, the linear resonant actuator generates haptic vibrations.

DETAILED DESCRIPTION

One embodiment of the present invention is a actuator with a unidirectional drive circuit. The drive circuit requires only one switch, which reduces the costs compared to known actuators and drive circuits for generating haptic effects.

Figure 1:
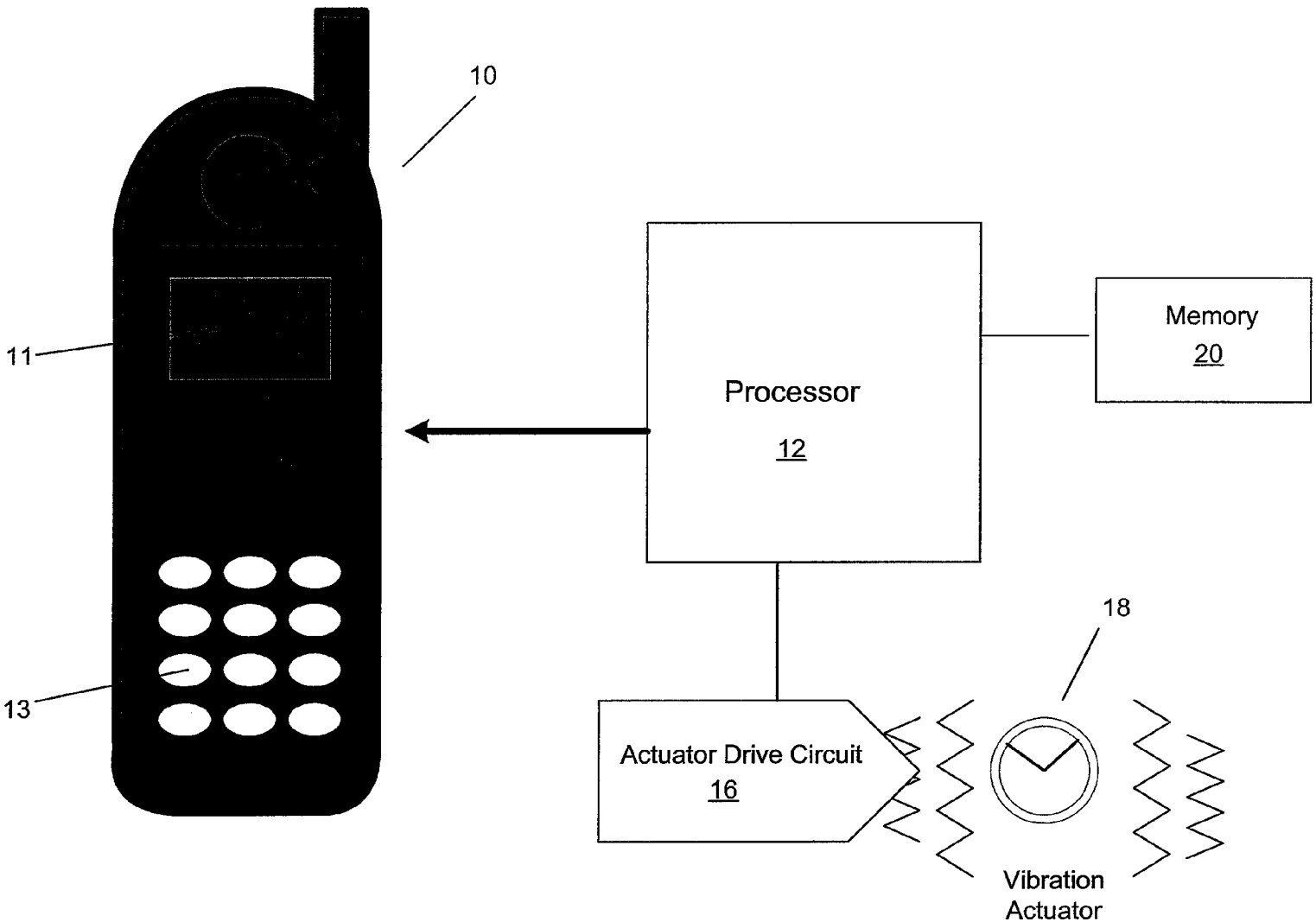
FIG. 1 is a block diagram of a cellular telephone in accordance with one embodiment of the present invention.

FIG. 1 is a block diagram of a cellular telephone 10 in accordance with one embodiment of the present invention. Telephone 10 includes a screen 11 and keys 13. In one embodiment, keys 13 are mechanical type keys. In another embodiment, keys 13 can be implemented by a touchscreen so that keys 13 are touchscreen keys, or can be implemented using any method. Internal to telephone 10 is a haptic feedback system that generates vibrations on telephone 10. In one embodiment, the vibrations are generated on the entire telephone 10. In other embodiments, specific portions of telephone 10 can be haptically enabled by the haptic feedback system, including individual keys of keys 13, whether the keys are mechanically oriented, touchscreen, or some other type of implementation.

The haptic feedback system includes a processor 12. Coupled to processor 12 is a memory 20 and an actuator drive circuit 16, which is coupled to a vibration actuator 18. Although the embodiment of FIG. 1 is a cellular telephone, embodiments of the present invention can be implemented with any type of handset or mobile/portable device, or any device that uses an actuator to generate vibrations.

Processor 12 may be any type of general purpose processor, or could be a processor specifically designed to provide haptic effects, such as an application-specific integrated circuit ("ASIC"). Processor 12 may be the same processor that operates the entire telephone 10, or may be a separate processor. Processor 12 can decide what haptic effects are to be played and the order in which the effects are played based on high level parameters. In general, the high level parameters that define a particular haptic effect include magnitude, frequency and duration.

Processor 12 outputs the control signals to drive circuit 16 which includes electronic components and circuitry used to supply actuator 18 with the required electrical current and voltage to cause the desired haptic effects. Vibration actuator 18 is a haptic device that generates a vibration on telephone 10. Actuator 18 can include one or more force applying mechanisms which are capable of applying a vibrotactile force to a user of telephone 10 (e.g., via the housing of telephone 10). Memory device 20 can be any type of storage device, such as random access memory ("RAM") or read-only memory ("ROM"). Memory device 20 stores instructions executed by processor 12. Memory device 20 may also be located internal to processor 12, or any combination of internal and external memory.

Figure 2:
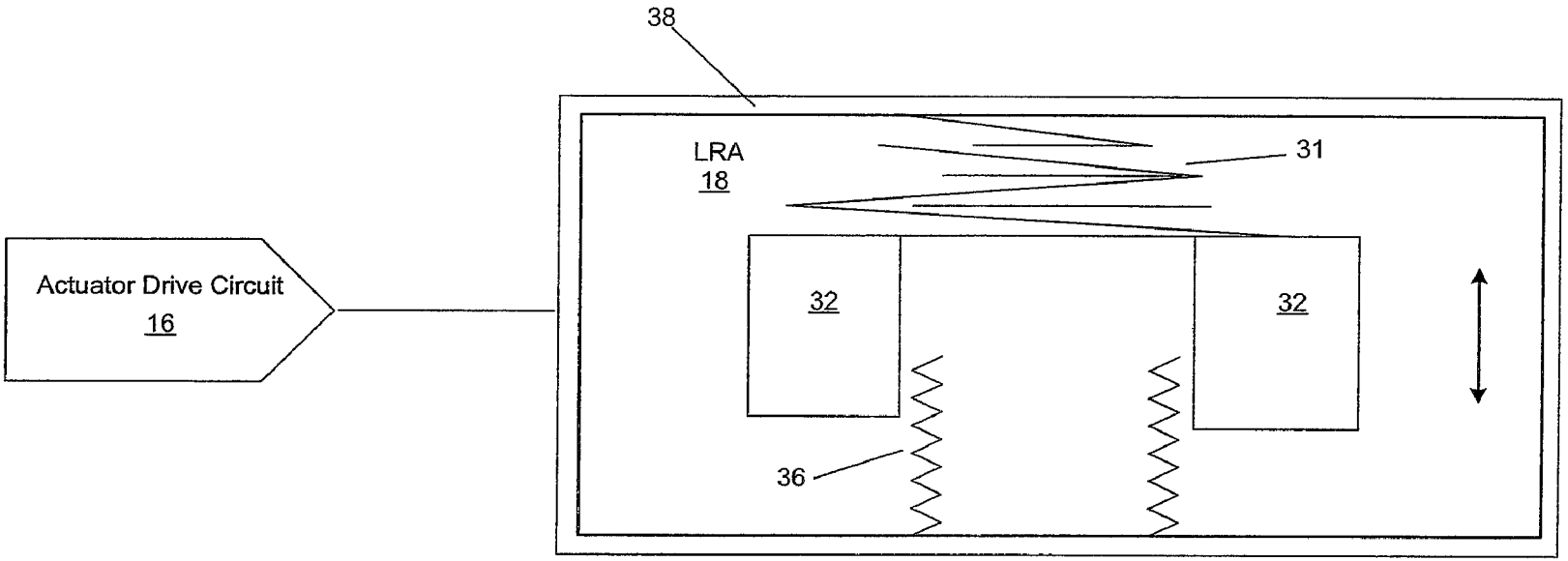
FIG. 2 is a cross-sectional view of an actuator coupled to a drive circuit in accordance with one embodiment of the present invention.

FIG. 2 is a cross-sectional view of actuator 18 coupled to drive circuit 16 in accordance with one embodiment of the present invention. Actuator 18 is a Linear Resonant Actuator ("LRA") and includes an annular magnetic coil 36 and an annular floater assembly 32. Assembly 32 includes a magnet (pill or puck-shaped), a magnetic flux return path element (e.g., a soft iron cup) and an annular mass element comprised, for example, of tungsten. Assembly 32 is coupled to a spring 31 which is coupled to a case 38. In operation, coil 36 is energized by drive circuit 16, which causes assembly 32 to move up and down against spring 31 in the direction of the arrow. This up and down action causes case 38 to vibrate.

As disclosed in more detail below, in embodiments of the present invention drive circuit 16 outputs a unidirectional (i.e., always positive voltage) signal to actuator 18. Therefore, drive circuit 16 can generate the unidirectional signal using a single switch, as opposed to a prior art drive circuit that generates a bidirectional signal and thus requires an H-bridge or similar complex circuitry to generate both positive and negative voltage. In one embodiment, the unidirectional signal is a sinusoidal wave or a square wave.

Figure 3:
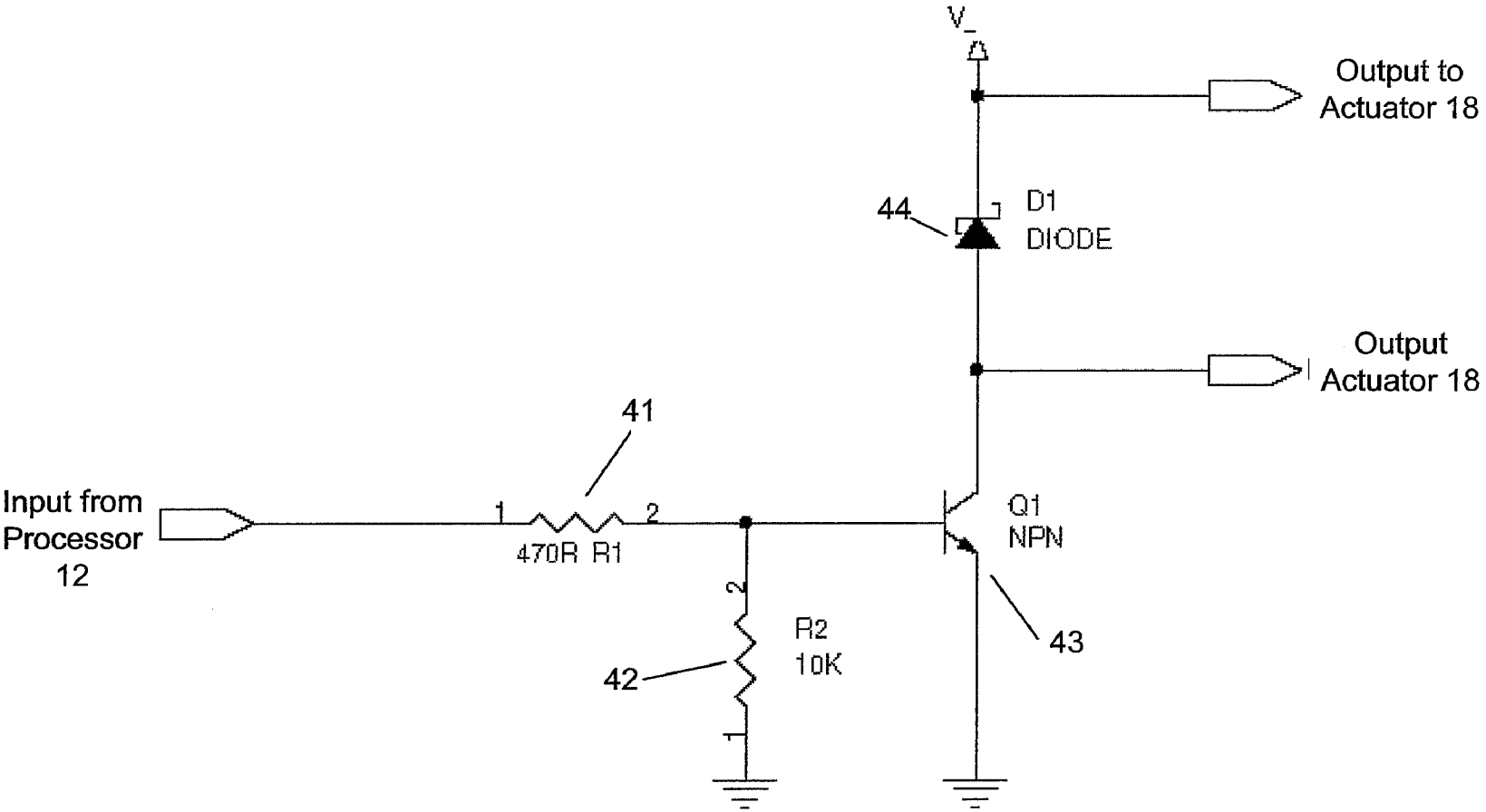
FIG. 3 is a circuit diagram of a drive circuit in accordance with one embodiment of the present invention.

FIG. 3 is a circuit diagram of drive circuit 16 in accordance with one embodiment of the present invention. The output haptic signal from processor 12 is input to a resistor 41 which is coupled to the base of an NPN transistor 43. The base of transistor 43 is further coupled to ground through a resistor 42. The emitter of transistor 43 is coupled to ground, and the collector of transistor 43 is coupled to the anode of a Schottky diode 44. The cathode of diode 44 is coupled to voltage. The anode and cathode of diode 44 are coupled to each terminal of actuator 18.

Figure 4:
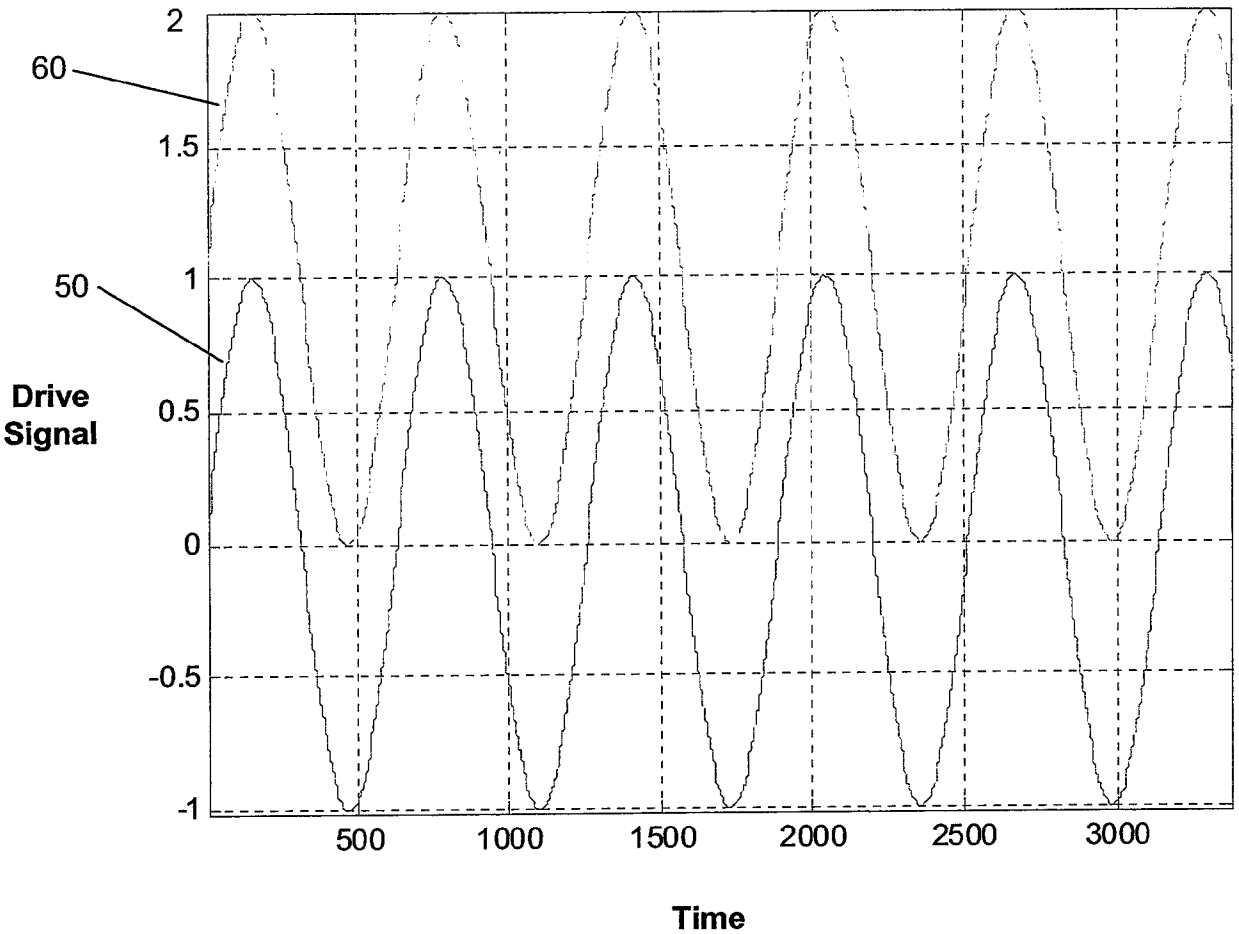
FIG. 4 is a graph of drive signal vs. time to illustrate the unidirectional signal generated by a circuit in accordance to an embodiment of the present invention compared to the prior art bidirectional signal.

FIG. 4 is a graph of drive signal vs. time to illustrate the unidirectional signal generated by circuit 16 in accordance to an embodiment of the present invention compared to the prior art bidirectional signal. Signal 50 is the prior art bidirectional signal and it fluctuates between 1 and −1 volts. Signal 60 is the unidirectional signal in accordance with one embodiment of the present invention and it fluctuates between 0 and 2 volts. In other embodiments, signal 50 may be any voltage that varies between negative and positive, and signal 60 may be any voltage that is always positive.

Unidirectional signal 60 applies all of the drive effort in one direction. An analogy of pushing a child on a swing can be used to compare unidirectional signal 60 with bidirectional signal 50. Bidirectional signal 50 is equivalent to pushing the swing on both sides of the cycle. In comparison, unidirectional signal 60 is equivalent to pushing twice as hard on one side of the swing cycle.

Figure 5A:
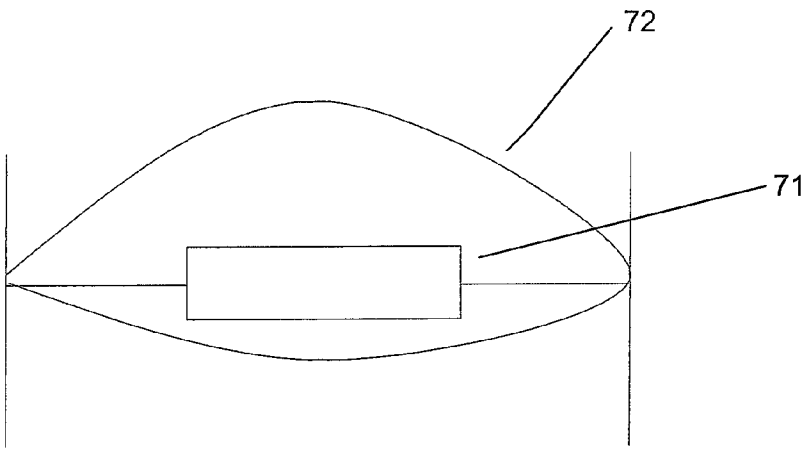
FIGS. 5*a* and 5*b* illustrate the range of motion of a floater assembly of an LRA driven by a unidirectional signal

In one embodiment, driving a known LRA with unidirectional signal 60 may cause the motion of floater assembly 32 of FIG. 2 to be offset. This may cause a problem due to the limited range of motion in case 38. FIG. 5*a* illustrates the range of motion (ellipse 72) of a floater assembly 71 of an LRA driven by a unidirectional signal in accordance with one embodiment of the present invention. As shown, the range of motion is offset.

Figure 5B:
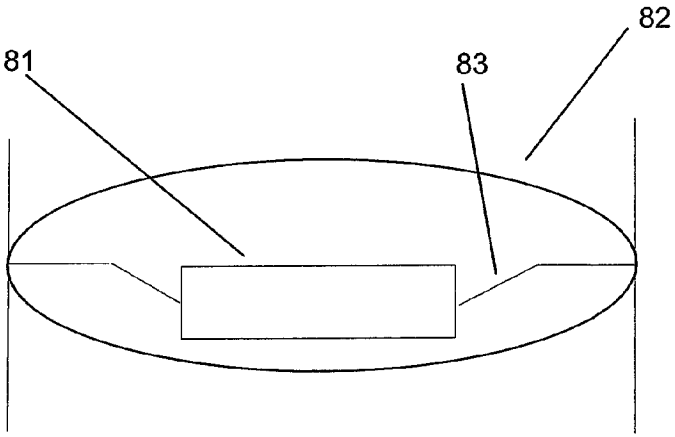

In contrast, in an embodiment of the present invention shown in FIG. 5*b*, a spring 83 of the LRA is offset so that a floater assembly 81 in equilibrium is further from the top of the case of the LRA. Thus, the range of motion (ellipse 82) is symmetrical even with the application of a unidirectional signal. In other embodiments, a non-linear spring can be used to limit the range of motion of the mass in one direction.

Several embodiments of the present invention are specifically illustrated and/or described herein. However, it will be appreciated that modifications and variations of the present invention are covered by the above teachings and within the purview of the appended claims without departing from the spirit and intended scope of the invention.

For example, some embodiments disclosed above are implemented in a cellular telephone, which is an object that can be grasped, gripped or otherwise physically contacted and manipulated by a user. As such, the present invention can be employed on other haptics enabled input and/or output devices that can be similarly manipulated by the user. Such other devices can include a touch screen (Global Positioning System ("GPS") navigator screen on an automobile, an automated teller machine ("ATM") display screen), a remote for controlling electronics equipment (audio/video, garage door, home security, etc.) and a gaming controller (joystick, mouse, specialized controller, etc.). The operation of such input and/or output devices is well known to those skilled in the art.

What is claimed is:

1. A haptic feedback generation system comprising:

a linear resonant actuator; and a drive circuit coupled to said linear resonant actuator, said drive circuit adapted to output a unidirectional signal;

wherein said linear resonant actuator comprises a spring, a magnetic coil and a floater assembly;

wherein the unidirectional signal is a sinusoidal signal with an amplitude that varies between a first voltage greater than or equal to zero and a second voltage greater than or equal to zero;

wherein the unidirectional signal, when applied to the actuator, causes the magnetic coil to be energized and the floater assembly to move, wherein the movement of the floater assembly generates a haptic force.

2. The system of claim 1, wherein said linear resonant actuator is adapted to receive the unidirectional signal and in response generate a vibration.

3. The system of claim 1, said drive circuit consisting of a switch.

4. The system of claim 1, wherein said spring is offset.

5. The system of claim 1, wherein said spring is non-linear.

6. The system of claim 1, wherein said floater assembly comprises a magnet.

7. The system of claim 1, wherein said signal comprises a magnitude, frequency and duration of the vibration.

8. The system of claim 1, wherein said drive circuit consisting of a transistor; a diode coupled to said transistor; and a first and second resistor coupled to said transistor.

9. A method of generating a haptic effect comprising:

generating a unidirectional signal;

applying the unidirectional signal to a linear resonant actuator; and based on the unidirectional signal, generating a vibration at the actuator;

wherein said linear resonant actuator comprises a spring, a magnetic coil and a floater assembly;

wherein the unidirectional signal is a sinusoidal signal with an amplitude that varies between a first voltage greater than or equal to zero and a second voltage greater than or equal to zero;

wherein the unidirectional signal, when applied to the actuator, causes the magnetic coil to be energized and the floater assembly to move, wherein the movement of the floater assembly generates the vibration.

10. The method of claim 9, wherein said spring is offset.

11. The method of claim 9, wherein said unidirectional signal comprises a magnitude, frequency and duration of the vibration.

12. A portable device comprising:

a linear resonant actuator;

a drive circuit coupled to said linear resonant actuator, said drive circuit adapted to output a unidirectional signal; and a processor coupled to said linear resonant actuator;

wherein said linear resonant actuator comprises a spring, a magnetic coil and a floater assembly;

wherein the unidirectional signal is a sinusoidal signal with an amplitude that varies between a first voltage greater than or equal to zero and a second voltage greater than or equal to zero;

wherein the unidirectional signal, when applied to the actuator, causes the magnetic coil to be energized and the floater assembly to move, wherein the movement of the floater assembly generates a haptic force.

13. The portable device of claim 12, wherein said linear resonant actuator is adapted to receive the unidirectional signal and in response generate a vibration.

14. The portable device of claim 12, said drive circuit consisting of a switch.

15. The portable device of claim 12, wherein said spring is offset.

16. The portable device of claim 12, wherein said spring is non-linear.

17. The portable device of claim 12, wherein said floater assembly comprises a magnet.

18. The portable device of claim 13, wherein said signal comprises a magnitude, frequency and duration of the vibration.

19. The portable device of claim 13, wherein said processor is programmed to generate control signals that are input to said drive circuit based on high level haptic parameters.

* * * * *